US011293358B1

(12) United States Patent
Parker

(10) Patent No.: US 11,293,358 B1
(45) Date of Patent: Apr. 5, 2022

(54) 2-CYCLE ENGINE

(71) Applicant: Billy Ray Parker, Norwood, NC (US)

(72) Inventor: Billy Ray Parker, Norwood, NC (US)

( * ) Notice: Subject to any disclaimer, the term of this patent is extended or adjusted under 35 U.S.C. 154(b) by 0 days.

(21) Appl. No.: 16/885,708

(22) Filed: May 28, 2020

(51) Int. Cl.

| | |
|---|---|
| ***F02D 13/02*** | (2006.01) |
| ***F02B 25/04*** | (2006.01) |
| ***F02D 19/10*** | (2006.01) |
| ***F02B 75/02*** | (2006.01) |

(52) U.S. Cl.
CPC ..... *F02D 13/028* (2013.01); *F02B 25/04* (2013.01); *F02B 2075/025* (2013.01); *F02D 19/10* (2013.01)

(58) Field of Classification Search
CPC ..... F02D 19/10; F02D 13/028; F02B 25/04; F02B 2075/025
See application file for complete search history.

(56) References Cited

U.S. PATENT DOCUMENTS 2,259,385 A * 10/1941 Lindenmuth ..... F01L 5/06 123/65 BA
2,425,157 A * 8/1947 Mallory ..... F02B 25/00 123/65 VB

OTHER PUBLICATIONS

2Stroke Stuffin, "Two Stroke Intake Types | Reed Valve, Rotary Valve, Piston Ported," Youtube, Nov. 13, 2017, https://youtu.be/DczDdGiBUdM (Year: 2017).*

* cited by examiner

*Primary Examiner* — Kevin A Lathers
(74) *Attorney, Agent, or Firm* — Tuggle Duggins P.A.; Blake P. Hurt

(57) ABSTRACT

A 2-cycle internal combustion engine in which the intake cycle begins before and ends after the exhaust cycle, resulting in a longer power stroke, increased torque and greater efficiency is disclosed herein. In the preferred embodiment, the 2-cycle engine has a power stroke of about 160 degrees, an exhaust stage of about 70 degrees, and an intake cycle of about 110-115 degrees.

11 Claims, 4 Drawing Sheets

2-CYCLE ENGINE

FIELD OF THE INVENTION

The invention herein pertains to internal combustion engines and, more particularly, to an improved 2-stroke cycle internal combustion engine.

DESCRIPTION OF THE PRIOR ART AND OBJECTIVES OF THE INVENTION

Internal combustion engines generally fall into two broad categories: 2-stroke cycle engines and 4-stroke cycle engines. These engines are also known as 2-stroke or 4-stroke engines, respectively. The names are derived from the number of times the piston moves within the cylinder to complete the four cycles of the combustion cycle: Intake, Compression, Combustion/Expansion (also known as the Power stroke), and Exhaust. In a 2-cycle (2-stroke) engine, the four cycles are completed by the piston moving through one down stroke and one up stroke within the cylinder, corresponding to one complete revolution of the crankshaft. In a 4-cycle (4-stoke) engine, the piston undergoes two up strokes and two down strokes to complete the four cycles, corresponding to two complete revolutions of the crankshaft.

2-cycle engines are typically of a much simpler design than a 4-stroke engine. This is in keeping with the industry standard set by General Motors with the introduction of their "2 cycle" engine in 1938, perhaps to keep the public from thinking their new engine introduced as a 2 stroke needed oil to be added to the fuel like in a "2 stroke lawnmower engine" of those times. For example, while most 4-stroke engines use valves to control the flow of air during the intake and exhaust cycles, the majority of 2-cycle engines, by contrast, use ports which are essentially, openings in the cylinder wall for fresh air intake. As the piston moves within the cylinder, the piston passes by the port to "open" or "close" the port.

A significant advantage of a 2-cycle engine is that it has superior power-to-weight ratio compared to 4-stroke engines. Because a 2-cycle engine has a power stroke with each complete revolution of the crankshaft, in theory they can produce twice the power of a comparable size 4-stroke engine, which have a power stroke for every two revolutions of the crankshaft. Stated differently, at equivalent power output, a 2-cycle engine can, in theory, be half the size of a 4-stroke engine.

In practice, however, the power output of a 2-cycle engine is only about 20-60% higher than a comparably sized 4-stroke engine. The reason is that the theoretical efficiency assumes that the cylinder is full of fresh fuel and air. However, operation of the 2-cycle engine allows a significant portion (up to 30%) of the unburned air/fuel mixture to escape into the exhaust and, because of back pressure, a portion of exhaust gas is allowed to remain in the cylinder during the following cycle. Thus, the mixture within the cylinder is a less efficient mix versus the theoretical and not all of the available fuel is burned. This is, and always has been, the challenge of the 2-cycle engines, especially of the automotive type that has not changed its inception.

These same adverse effects explain the major drawbacks to 2-cycle compared to their 4-stroke counterparts, namely, pollution and lack of torque. For example, during operation of a 2-cycle engine, the compressed air/fuel mixture is ignited to begin the combustion cycles. Ignition generally occurs at or near the top of the piston movement within the cylinder, referred to as "top dead center" or "TDC". The air/fuel mixture, once ignited, expands rapidly and forces the piston downward. This is referred to as the "power" stroke. As the piston travels downward, but before it has reached the bottom of its movement (termed "bottom dead center" or "BDC"), the exhaust valve opens. Later in the movement of the piston, but still before the piston has reached BDC, the intake (transfer) port will open. Thus, during the single downward stroke, the 2-cycle engine experiences the combustion, exhaust and intake (sometimes referred to as scavenging) cycles. As the piston reaches BDC and begins to travel upward, the intake port closes shortly before the exhaust valve(s) close and the compression cycle begins. Thus, on the upward stroke, the engine will undergo most or all of the intake, exhaust and compression cycles.

The method of operation of the 2-cycle engine creates certain inefficiencies compared to the 4-stroke engine. For example, when the exhaust ports open during the combustion cycle in the 2-cycle engine, some of the unburned fuel particles can escape into the exhaust system. While some of those particles can be captured and redelivered to the combustion chamber, a portion of the unburned fuel mixture is emitted to the environment. This is the result of a certain design flaw that requires the ignited air/fuel mixture to change directions; after ignition explosion forcing the piston and gases downward, these same gases (after benefit of ignition) are then redirected back to the top of the cylinder via the opening of the intake port, where fresh air is being pumped into the cylinder. Exhaust back pressure from this operation will also allow some of these gases into the engines common cylinder air box. The problem has been found to be that some raw fuel particles as well are being directed straight into the environment via the engines exhaust. As these antiquated designs were turbo charged, extra fuel was added to try to compare to a 4 stroke engines power. This solution did not work, and it was found that this only exacerbated the already difficult EPA problems. In 4-stroke engines, by contrast, the exhaust valves typically do not begin to open until the piston has reached bottom dead center and is on its way back up the cylinder. This allows more time for the air/fuel mixture to remain in the cylinder and thus a more complete isolated burn in the engine cylinder.

Another disadvantage of the 2-cycle engine is that they cannot match the amount of torque produced by a 4-stroke engine of the same horsepower due to the more limited power stroke (approximately 93°) compared to the benefit of the nearly 180° of the 4-stroke, resulting in a considerable less twisting force effort on the crankshaft. In the present context, torque is a twisting force that results in rotational movement of the crankshaft in the engine. All things being equal, the longer the stroke, the more torque is applied to the crankshaft. However, in a 4-stroke engine, the power stroke lasts for nearly the full movement of the piston from its uppermost point ("top dead center" or "TDC") to BDC, which applies torque to the crankshaft for nearly 180 degrees of rotation. By contrast, in the 2-cycle engine, during the combustion of the air/fuel mixture, the exhaust valve(s) start to open at approximately 93° and the intake ports start to open at approximately 120°, resulting in a loss of pressure as the piston is forced downward toward BDC and reducing the amount of torque applied to the crankshaft.

Still another disadvantage of 2-stroke engines, and specifically 2-stroke diesel engines, is that they require a forced air intake system. Such systems often manifest themselves as blowers or air pumps that force air into the cylinder. The need for blowers adds considerable cost and weight to the 2-cycle diesel engine.

Attempts have been made in the prior art to address the deficiencies noted above. For example, U.S. Pat. No. 6,044,812 (the '812 patent") teaches modifications to a 2-cycle Detroit Diesel Series 92 Turbo Charged Engine. The modifications taught by the '812 patent include increasing the travel of the exhaust valve to provide a larger annular exhaust opening and lowering the intake ports, which effectively increases the length of the power stroke, resulting in improved torque. The modifications do not change the sequence of the intake and exhaust cycles and do not change the total time period or degrees of crankshaft rotation during which the exhaust valves are open. The teaching of the '812 patent also does nothing to address the adverse effects of an engine with a common air box to all cylinders, which is the cause of un-combusted raw fuel particles (i.e. dirty exhaust) in such a design as the original and is continued in this patent.

Accordingly, there is a need for a 2-cycle engine that has improved fuel efficiency, produces less pollution and has increased torque. It is thus a primary objective of the invention to provide a 2-cycle engine that has improved fuel combustion efficiency.

It is another objective of the invention to provide a 2-cycle engine that produces higher torque.

It is yet another objective of the invention to provide a 2-cycle engine that emits lower levels of unburned fuel and thus is more environmentally friendly.

It is yet a further objective of the invention to provide a 2-cycle diesel engine that is cranked naturally aspirated, thus eliminating a power robbing gear driven air pump.

It is a further objective of the invention to provide a 2-cycle engine that has a power stroke of at least 160 degrees.

Yet another objective of the invention is to provide a 2-cycle engine that incorporates a trapezoidal shaped exhaust port for better exhaust exit control.

It is yet another objective of the invention to provide a 2-cycle engine in which the intake cycle begins earlier and end later than the exhaust cycle, helping to run a cleaner combustion cylinder, one where the cylinder is flushed continually with fresh, uncontaminated particles from combustion well after adequate time for full benefit of burnt fuel expansion.

These and other objectives of the invention will become apparent upon a further reading of the detailed description with reference to the drawings and appended claims.

SUMMARY OF THE INVENTION

A 2-cycle internal combustion engine has an engine block, a cylinder head attached to the block, a piston located within a bore in the cylinder head for linear movement therein, and a crankshaft located within the engine block and operatively connected to the piston. The cylinder head has an exhaust port located near the bottom of the bore and an intake valve located near top of the bore. The exhaust port and intake valve are in fluid communication with the bore. The exhaust port preferably has a trapezoidal shape in cross section for better timed and complete cylinder scavenging.

In the present invention, the sequence of operation for the exhaust and intake cycles is reversed compared to prior art engines. In addition, the intake cycle starts earlier and lasts longer than the exhaust cycle. More specifically, the intake valve will begin to open after approximately 135-140 degrees (+1-5 degrees) of crankshaft rotation from TDC. There will be an additional 20-25 degrees of rotation before the exhaust port will begin to open at approximately 160 degrees (+/−5 degrees) of rotation from TDC. The exhaust port will remain open and will not close until approximately 230 degrees (+/−5 degrees) of rotation from TDC. The intake valve will close after approximately 250 degrees (+/−5 degrees) of rotation. The 2-cycle engine of the invention thus provides a power stroke of approximately 160 degrees (+/−5 degrees), an exhaust cycle of approximately 70 degrees (+1-5 degrees) and a compression cycle of approximately 110-115 degrees (+/−5 degrees). During the aforementioned stroke cycles the air flow is continually in the same direction, from ambient air being pulled into the cylinder, any turbo charged air and most importantly the igniting of the fuel and burnt gases also continuing down the cylinder to their final cylinder exit post. There is no significant change of direction of any air or mixtures. Also, with no common cylinder air box, there is no excessive back pressure or carbon forming deposits.

The arrangement of structure and sequence as described results in unidirectional air flow, more efficient burning of fuel, less pollution and greater torque than prior art 2-cycle engines.

BRIEF DESCRIPTION OF THE. DRAWINGS

DETAILED DESCRIPTION OF THE PREFERRED EMBODIMENT AND OPERATION OF THE INVENTION

Figure 1:
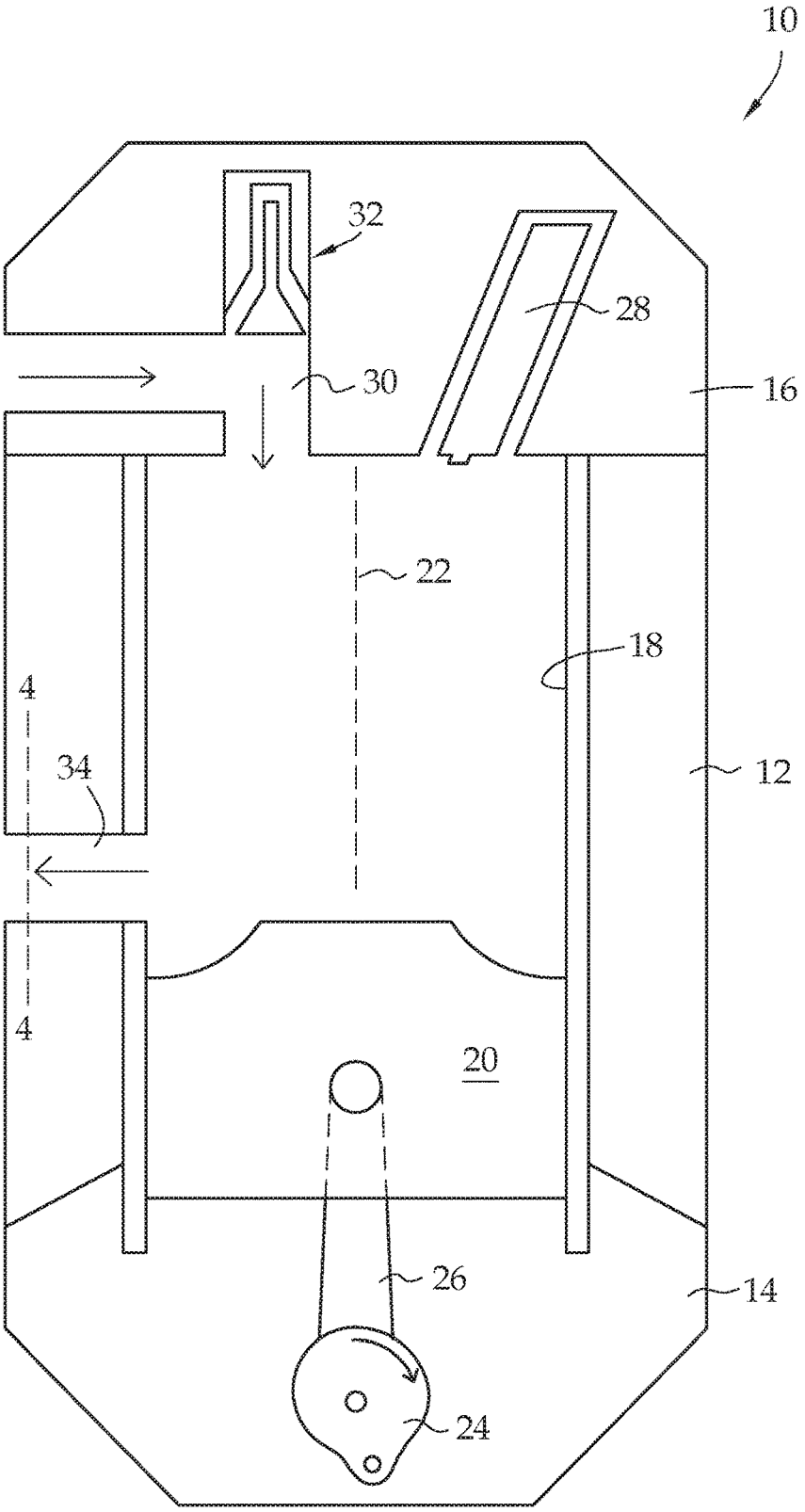
FIG. 1 is a schematic illustration of a preferred embodiment of the 2-cycle engine of the present invention

For a better understanding of the invention and its operation, turning now to the drawings, Referring first to FIG. 1, a preferred embodiment of a 2-cycle engine of the invention is schematically shown therein. The engine 10 is defined by an engine block 12, a crankcase 14 and a cylinder head 16. The engine block contains a bore 18 defining a combustion cylinder. A piston 20 is disposed within the bore 18 for movement therein parallel to the longitudinal axis 22 of the bore 18. Piston 20 is operatively connected to crankshaft 24 by a connecting rod 26, whereby linear motion of the piston 20 within the bore 18 will translate to rotational movement to the crankshaft 24.

The cylinder head 16, in the embodiment shown, may preferably include a fuel injector, such as electronic unit injector 28 which injects fuel into the bore 18 at the appropriate, predetermined point in the combustion cycle. An intake valve 30 is in fluid communication with the bore 18 and is operatively controlled by a valve 32. When the valve 32 is open, as shown in FIG. 1, air can be drawn through the intake port 30 and into the bore 18 for use in the combustion process. In the embodiment shown, the intake port and valve are contained within the cylinder head 16 and thus are located at or near the top of bore 18.

An exhaust port 34 is also in fluid communication with the bore 18. In the preferred embodiment, exhaust port 34 defines a trapezoidal shape, which is not merely a design choice but rather is engineered for a more versatile engine, regardless of fuel type. Unlike the intake 30, and those intake orifices taught in the prior art, preferred exhaust port 34 is located below a lateral plane that intersects the midline of intake port 30. In this configuration, it would be understood that intake port 30 and exhaust port 34 are in different lateral planes which are perpendicular to longitudinal axis 26. In FIG. 1, the piston 20 is shown near the lowermost end of the bore 18, which corresponds to bottom dead center ("BDC"), The exhaust port 34 is preferably located just above the top of piston 20 when the piston is at BDC. As explained below, by locating the exhaust port 34 low in the bore 18 delays opening of the exhaust pathway to later in the combustion cycle, thus increasing the effective length of the power stroke.

Figure 2:
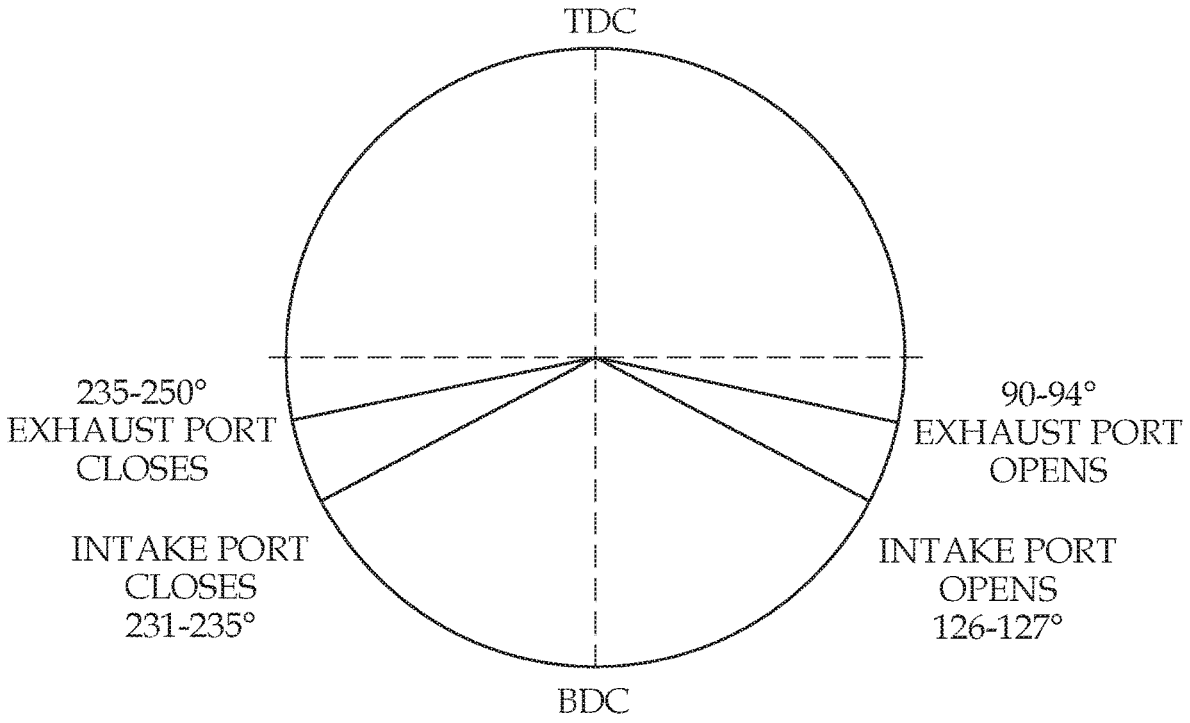
FIG. 2 is a circular diagram of the stages of the combustion cycle in a typical 2-stroke engine.
Figure 3:
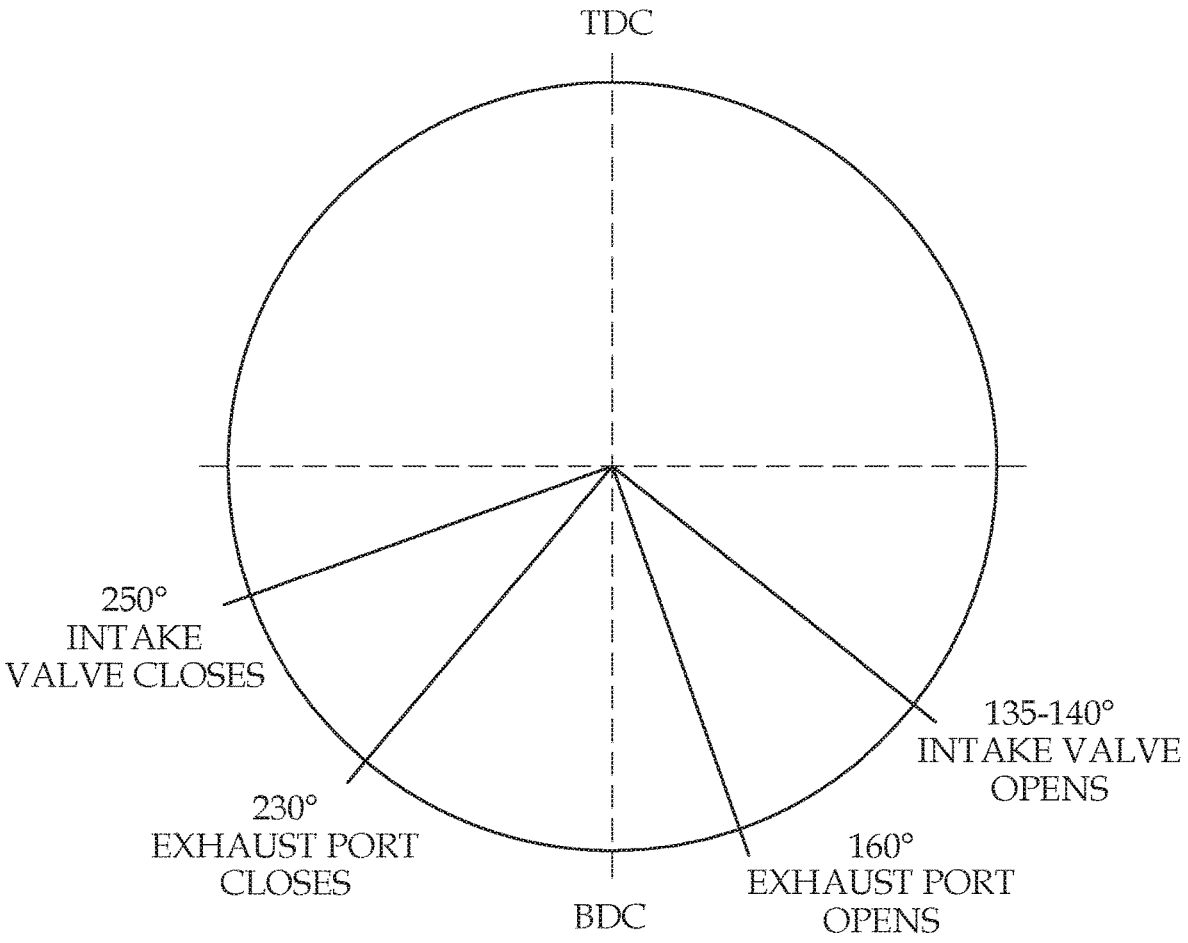
FIG. 3 is a circular diagram of the stages of the combustion cycle in a preferred embodiment of the present invention.

With reference now made to FIGS. 2 and 3, the differences in the combustion cycle as between the prior art 2-cycle engine and the 2-cycle engine of the present invention can be compared. These FIGS. depict the stages of a combustion cycle in reference to the rotational movement of the crankshaft and are typically referred to as "circular", "clock", or "pie" diagrams. The dock diagram in FIG. 2 shows the stages of a combustion cycle of a typical prior art 2-stroke engine, such as that disclosed in the aforementioned U.S. Pat. No. 6,044,812, the entire disclosure of which is incorporated herein by reference. The dock diagram of FIG. 3 shows the stages of a combustion cycle of an embodiment of the present invention.

As seen in FIG. 2, the prior art 2-stroke engine began the exhaust cycles at approximately 90-94 degrees (+/−2 degrees) from top dead center ("TDC") and ended at approximately 231-235 degrees (+/−1-2 degrees) from TDC. This figure also shows that the intake cycle begins at approximately 126-127 degrees (+/−2 degrees) from TDC and ends at approximately 231-235 degrees (+1-2 degrees) from TDC. In the preferred embodiment of the 2-stroke engine of the invention (FIG. 3) it is seen that the order of the exhaust and intake cycles are reversed from prior art engines. Specifically, at about 135-140 degrees (+/−2 degrees) from TDC, the intake cycle begins when the intake valve 32 begins to open and does not close until about 250 degrees (+/−2 degrees) from TDC. The exhaust cycle begins at about 160 degrees (+/−2 degrees) from TDC when the exhaust port begins to open and ends when the piston has blocked the exhaust port at about 230 degrees (+1-2 degrees) from TDC.

Accordingly, the 2-cycle engine of the present invention reverses the sequence of the intake and exhaust stages of the combustion cycle. Not only does the intake cycle begin earlier, but it also last longer than the exhaust cycle, another difference from the prior art 2-cycle engines. These modifications result in significant improvements in engine function over prior art designs. For example, the airflow through the bore 18 is improved as fresh air is drawn in through the intake port 34 at the top of the bore 18 before the gasses from burning of the air/fuel mixture escape out the exhaust port. The improved unidirectional airflow allows the engine to be cranked naturally aspirated and eliminates the need for a turbo to crank heavy and expensive blowers or air pumps. In an embodiment with a turbo (i.e. free, exhaust-driven pressurized air), said turbo is thus free to take over aspiration for continued engine acceleration and be fueled for maximum power output. This is made possible by the unique intake and exhaust placement of the instant new design. The new 2-cycle unidirectional air flow allows for an unexpected, novel phenomenon that makes some or all of the benefits of the instant engine possible. That is due to the fact that as a cylinder ignites its air/fuel mixture at or near TDC that at some point, at some degree of crankshaft rotation of the pistons downward travel relationship in the cylinder will create enough vacuum to pull enough fresh air in through the intake valves assisted by the venture-type orifice being exposed at the top of the trapezoidal exhaust port as the piston travels downward enough to keep those burnt gases low in the cylinder. The intake valves being in the top of the cylinder and the more exhaust port being exposed as the piston travels downward keeps everything flowing in the same direction. This also allows for an abundance of cylinder cleaning air. This air will also assure that there is more than adequate air to completely burn all fuel that was supplied to the cylinder.

Another improvement resulting from these modifications is the increased duration of the power stroke (i.e., combustion/expansion cycle(s)) from approximately 120 degrees (+/−2 degrees) in the prior art (and in actuality starting to end the power stroke at 93° as the exhaust valves begin to open) to about 160 degrees (+/−2 degrees) in the present invention. The longer power stroke results in increased torque output.

Figure 4:
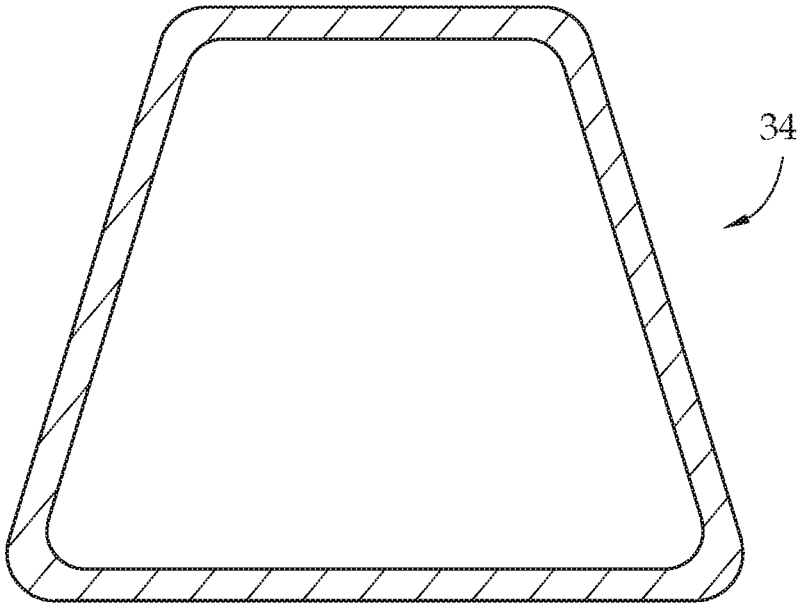
FIG. 4 is an enlarged cross-section of the exhaust port in the preferred embodiment of the 2-cycle engine of the present invention, as seen along line 4-4 of FIG. 1.

FIG. 4 shows a preferred cross sectional shape of the exhaust port 34 of the present invention. As described above, the preferred shape of exhaust port 34 is trapezoidal, with the wider parallel side 40 located closer to the bottom of the bore 18 and the narrower parallel side 42 located closest to the cylinder head 16. This to cause a venturi type effect or the speeding up of the exhaust gases as they are continuing to travel downward in the cylinder. As the piston moves downward more of the port is exposed to help evacuate the cylinder of burnt gases so the cylinder can be purged completely and flushed with clean ambient air. Not only giving clean air for the next engine cycle in the cylinder but flushing out the engines exhaust and help filter burnt air gas exhaust by helping to purify exhaust concentrating with cleaner air.

Although not shown in the FIGS., it will be understood by the skilled worker that additional modifications may be made to the engine of the invention. For example, in an alternate embodiment, an exhaust driven turbocharger may be employed to further increase efficiency. Various other substitutions or modifications to the embodiments illustrated and described may suggest themselves to those skilled in the art upon reading this disclosure. Accordingly, the illustrations and examples provided herein are for explanatory purposes and are not intended to limit the scope of the appended claims.

I claim:

1. A 2-cycle engine comprising: an engine block defining a bore with a longitudinal axis; a piston disposed within the bore for linear movement parallel to a longitudinal axis of the bore and operatively connected to a crankshaft; an intake port in fluid communication with the bore and located near the top of said bore; and an exhaust port in fluid communication with the bore and located near the bottom of said bore; wherein in operation of the engine, the engine undergoes combustion cycles of intake, compression, combustion/expansion and exhaust; wherein during the combustion/expansion cycle, the intake port opens at about 135-140 degrees after top dead center and closes at about 250 degrees after top dead center while the exhaust port opens after the intake port at about 160 degrees after top dead center and closes at about 233 degrees after top dead center; and wherein the intake port and the exhaust port are each oriented transverse to the longitudinal axis of the bore, the intake port and the exhaust port positioned in different ones of laterals planes which are defined perpendicular to the longitudinal axis and that are spaced from one another along the longitudinal axis of the bore.

2. The 2-cycle engine of claim 1, wherein the intake port is controlled by a valve.

3. The 2-cycle engine of claim 1, wherein the exhaust port comprises an opening in a wall of the bore, the exhaust port having a trapezoidal cross-sectional configuration.

4. The 2-cycle engine of claim 3, wherein the exhaust port having a trapezoidal cross-sectional configuration is further defined as an isosceles trapezoidal cross-section.

5. The 2-cycle engine of claim 1, wherein the engine is naturally aspirated.

6. A method of operation of the 2-cycle engine of claim 1, the method comprising: an intake cycle that begins at about 135-140 degrees after top dead center and ends at about 250 degrees after top dead center; and an exhaust cycle that begins at about 160 degrees after top dead center and ends at about 230 degrees after top dead center.

7. The 2-cycle engine of claim 6, wherein the intake cycle is controlled by operation of a valve.

8. The 2-cycle engine of claim 6, wherein an exhaust cycle is controlled by movement of the piston against the exhaust port.

9. The 2-cycle engine of claim 6, wherein an exhaust cycle is controlled by movement of the piston against the exhaust port and wherein the exhaust port defines a trapezoidal cross-sectional shape.

10. The 2-cycle engine of claim 6, wherein the engine is naturally aspirated.

11. The 2-cycle engine of claim 1 further comprising an electronic fuel injector configured to inject fuel into the bore at an appropriate, predetermined point in the combustion cycle.

* * * * *